US007189086B2

(12) United States Patent
Fukatsu et al.

(10) Patent No.: US 7,189,086 B2
(45) Date of Patent: Mar. 13, 2007

(54) CONNECTOR, CONNECTOR ASSEMBLY AND ASSEMBLING METHOD THEREFOR

(75) Inventors: Yukihiro Fukatsu, Yokkaichi (JP); Yukihiro Toyoda, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/481,229

(22) Filed: Jul. 5, 2006

(65) Prior Publication Data

US 2007/0010113 A1 Jan. 11, 2007

(30) Foreign Application Priority Data

Jul. 5, 2005 (JP) ..... 2005-196420

(51) Int. Cl.
*H01R 13/62* (2006.01)

(52) U.S. Cl. ..... 439/157

(58) Field of Classification Search ..... 439/157, 439/372, 152, 153

See application file for complete search history.

(56) References Cited

U.S. PATENT DOCUMENTS

| | | | | |
|---|---|---|---|---|
| 6,382,992 | B1 | 5/2002 | Bouchan et al. | |
| 6,764,324 | B2 * | 7/2004 | Shinozaki et al. | 439/157 |
| 6,805,564 | B2 * | 10/2004 | Shinozaki et al. | 439/157 |
| 7,063,547 | B2 * | 6/2006 | Toyoda et al. | 439/157 |
| 2001/0044228 | A1 * | 11/2001 | Noro et al. | 439/157 |
| 2001/0046798 | A1 * | 11/2001 | Noro et al. | 439/157 |
| 2002/0016100 | A1 | 2/2002 | Okabe et al. | |
| 2002/0064984 | A1 * | 5/2002 | Ishikawa et al. | 439/157 |
| 2003/0017026 | A1 | 1/2003 | Tachi | |
| 2003/0017733 | A1 * | 1/2003 | Fujii | 439/157 |
| 2004/0121640 | A1 | 6/2004 | Okamota et al. | |
| 2006/0040533 | A1 | 2/2006 | Koshy et al. | |
| 2006/0089030 | A1 * | 4/2006 | Fukatsu | 439/157 |

FOREIGN PATENT DOCUMENTS

| | | |
|---|---|---|
| JP | 8167448 | 6/1996 |
| JP | 2004-319125 | 11/2004 |

* cited by examiner

*Primary Examiner*—Tulsidas C. Patel
*Assistant Examiner*—Vladimir Imas
(74) *Attorney, Agent, or Firm*—Gerald E. Hespos; Anthony J. Casella

(57) ABSTRACT

A lever (11) is mounted in a female housing (10) for rotation between a standby position and a connection position. The lever (11) has resiliently deformable locking claws (17) that contact engaging portions (18) formed at free end edges of outer surfaces of the female housing (10) if an attempt is made to rotate the lever (11) at the standby position. A contact surface (53) and a turn-up preventing portion (55) are formed at the leading end of each locking claw (17). The contact surface (53) can be contact the corresponding engaging portion (18) and the turn-up preventing portion (55) can press the engaging portion (18) to prevent the engaging portion (18) from being turned up. Thus, a holding force for holding the lever (11) at the standby position can be increased.

9 Claims, 10 Drawing Sheets

CONNECTOR, CONNECTOR ASSEMBLY AND ASSEMBLING METHOD THEREFOR

BACKGROUND OF THE INVENTION

1. Field of the Invention

The invention relates to a connector with a movable member, such as a lever, for assisting connection.

2. Description of the Related Art

Japanese Unexamined Patent Publication No. 2004-319125 discloses a connector with a first housing that can be connected with a second housing. A lever is mounted rotatably on the first housing and can be rotated from a standby position to a connection position. The lever has an arm formed with a cam groove. A cam follower is formed on the second housing and can be received in the cam groove when the lever is at the standby position. The lever then can be rotated to the connection position for connecting the first and second housings. A resilient locking piece is cantilevered from the arm of the lever and contacts a notched groove formed in an outer wall of the first housing to prevent rotation of the lever towards the connection position before the second housing is positioned for connection.

The outer wall of the above-described first housing is thin and the notched groove is formed in this thin outer wall. An end edge of the notched groove, in some cases, can deform along the thickness direction of the outer wall. The free end of the notched groove that contacts the locking piece can be turned up and can deform sufficiently to move onto the locking piece. Therefore, an insufficient holding force may exist between the resilient locking piece and the notched groove.

The present invention was developed in view of the above problem and an object thereof is to provide for an increased holding force upon holding a movable member on or in a housing at a standby position.

SUMMARY OF THE INVENTION

The invention relates to a connector with a housing that is connectable with a mating housing of a mating connector. A movable member is mounted on the first housing and is displaceable between a standby position and a connection position. The movable member has a side plate formed with a cam that is engageable with a mating cam of the mating housing when the housing is fit lightly to the mating housing while the movable member is at the standby position. The movable member then can be displaced to the connection position and generates a cam action to connect or assist connection of the housing with the mating housing. The side plate of the movable member is formed with at least one locking claw that is resiliently deformable along the thickness direction of the side plate. The locking claw is formed with a contact surface. An engaging portion is formed on the housing and is engageable with the contact surface of the locking claw. The locking claw and the engaging portion engage with each other when the movable member is at the standby position and prevent the movable member from displacing towards the connection position. The locking claw deforms in an unlocking direction and disengages from the engaging portion due to the engagement with the second housing when the two housings are fit lightly together and when the movable member is at the standby position. A displacement path of the movable member from the standby position to the connection position is in substantially the same direction as a direction in which the contact surface contacts the engaging portion. The locking claw has a deformation preventing portion for pressing the engaging portion in a direction opposite to an unlocking direction of the locking claw to prevent the engaging portion from being deformed when the contact surface and the engaging portion contact each other upon displacing the movable member before a connecting operation of the housing with the mating housing.

Accordingly, a sufficient holding force can be ensured between the locking claw and the engaging portion since the deformation preventing portion prevents the engaging portion brought into contact with the contact surface from undergoing such a resilient deformation as to move onto the locking claw.

The contact surface preferably has a slanted or rounded surface for exerting a force on the locking claw in a direction opposite to the unlocking direction of the locking claw when the contact surface contacts the engaging portion. Thus, a deformation of the locking claw in the unlocking direction is prevented when the contact surface contacts the engaging portion, and the locking claw and the engaging portion engage securely.

The second housing preferably includes a restriction lifting portion for contacting the locking claw when the housings are fit lightly together with the movable member at the standby position and for deforming the locking claw in the unlocking direction to disengage the locking claw from the engaging portion. Thus, operation efficiency is improved as compared to a case where a separate step of disengaging the locking claw and the engaging portion is necessary.

The movable member preferably is made of a synthetic resin. The locking claw is formed inside a slit made in the side plate and formed by a mold openable and closable along the thickness direction of the locking claw.

The slanted surface preferably is displaced from the deformation preventing portion in the width direction of the locking claw. Accordingly, the locking claw is arranged inside the movement path of the movable member to prevent the enlargement of the movement path of the movable member and to prevent enlargement of the housing.

With the above-described construction, the movable member is formed using a mold openable and closable along the thickness direction of the locking claw. Thus, no spaces used to remove mold parts for forming the deformation preventing portion and the slanted surface can be ensured since the locking claw is surrounded by the side plate if the deformation preventing portion and the slanted surface are arranged to overlap in the thickness direction of the locking claw. Therefore, there is a possibility of being unable to form the deformation preventing portion and the slanted surface.

In view of the above, the deformation preventing portion and the slanted surface preferably are displaced in the width direction of the locking claw. Therefore, the deformation preventing portion and the slanted surface can be formed by a mold openable and closable along the thickness direction of the locking claw.

The operating direction of the movable member at the standby position preferably is substantially opposite the connecting direction of the housings.

The invention also relates to a connector assembly comprising the above-described connector and a mating connector connectable therewith. The housing of the connector is connectable with the mating housing of the mating connector and the connection of the housings is performed or assisted by the operation of the movable member in or on the connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERERD EMBODIMENTS

Figure 1:
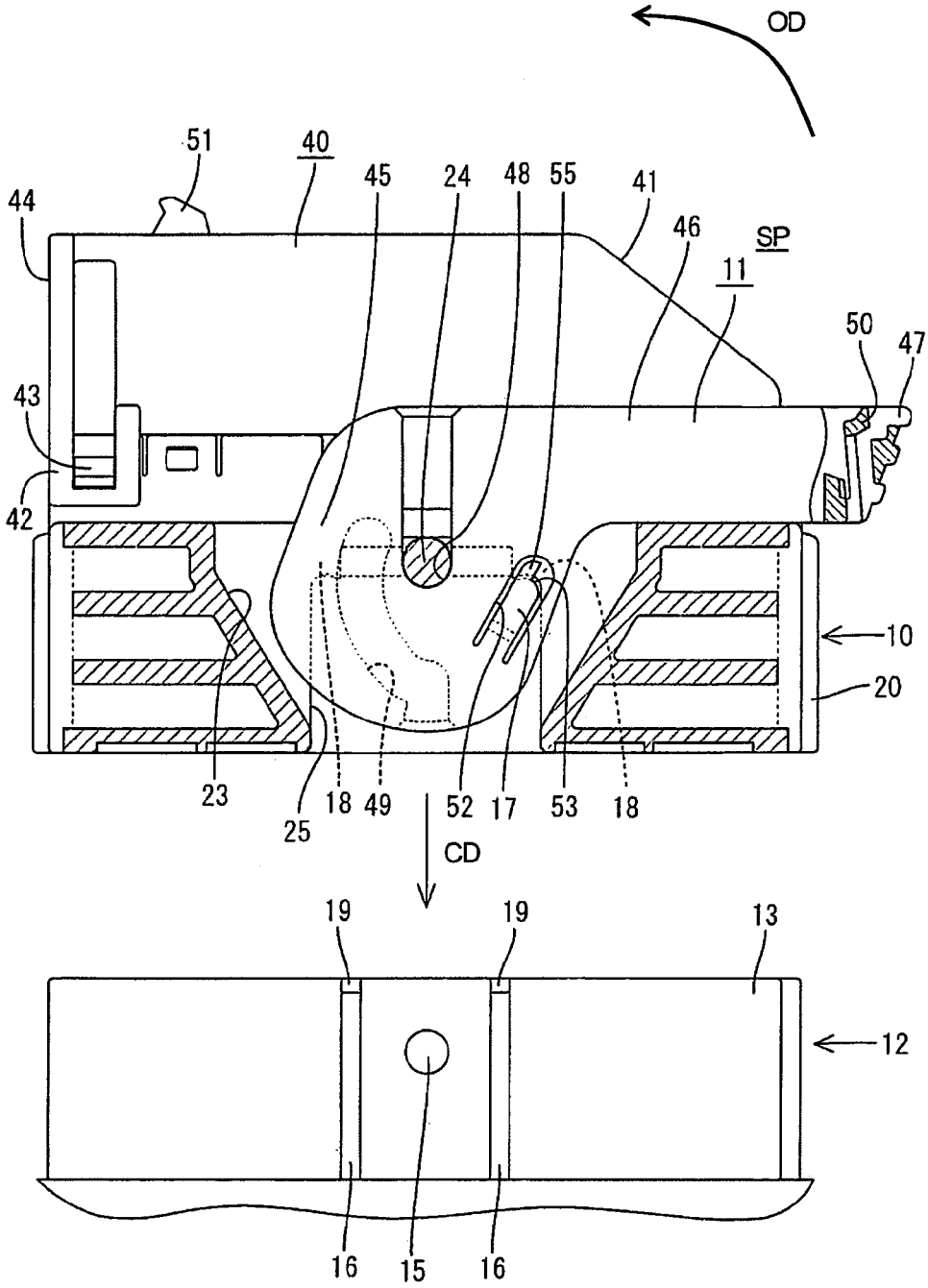
FIG. 1 is a plan view of a male housing and a female housing of a lever-type connector according to one embodiment of the invention with the female housing having a lever mounted at a standby position therein shown partly in section.
Figure 2:
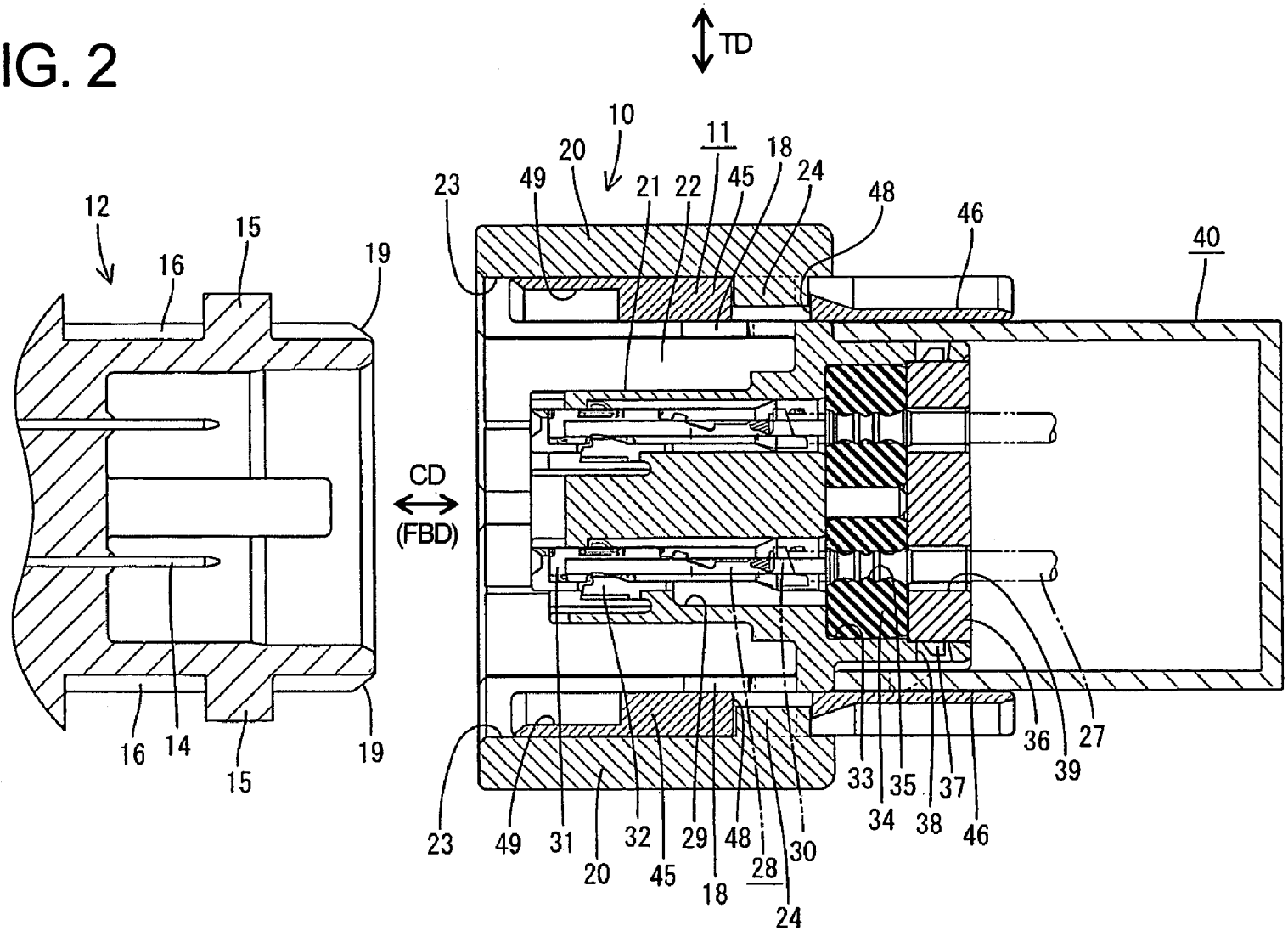
FIG. 2 is a section of the male housing and the female housing having the lever mounted at the standby position therein.
Figure 3:
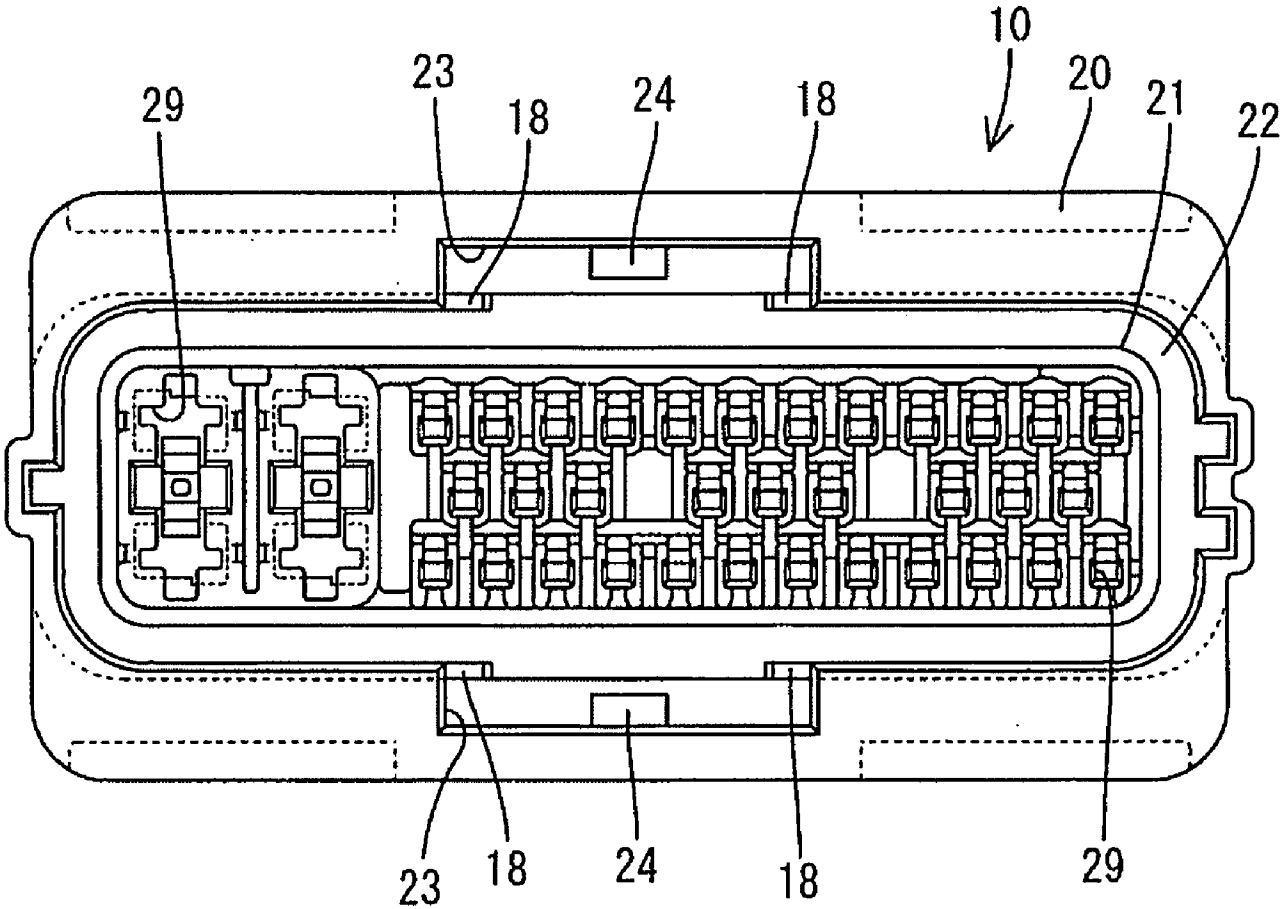
FIG. 3 is a front view of the female housing.
Figure 4:
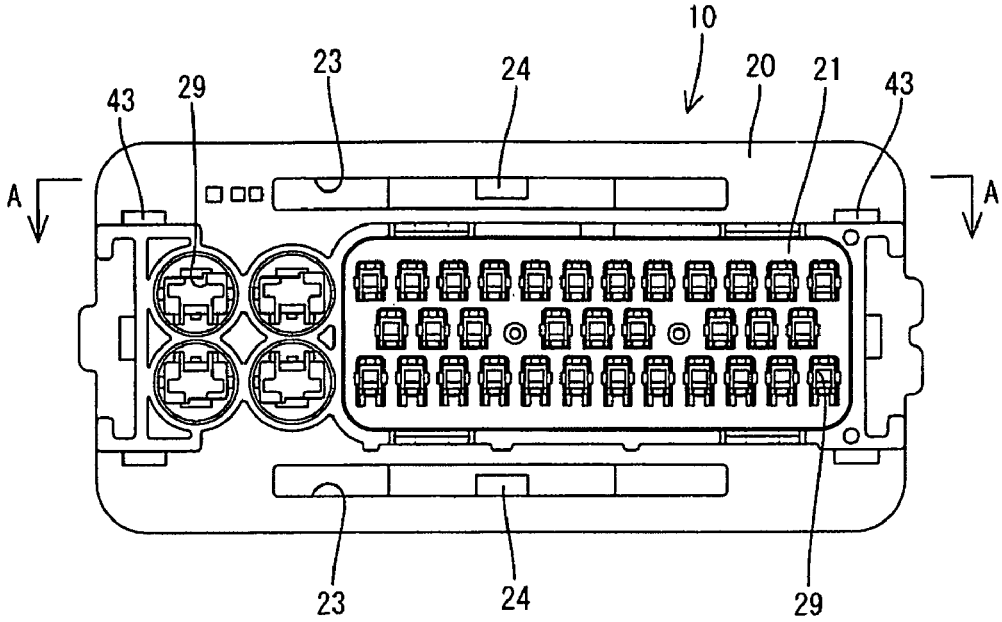
FIG. 4 is a rear view of the female housing.
Figure 5:
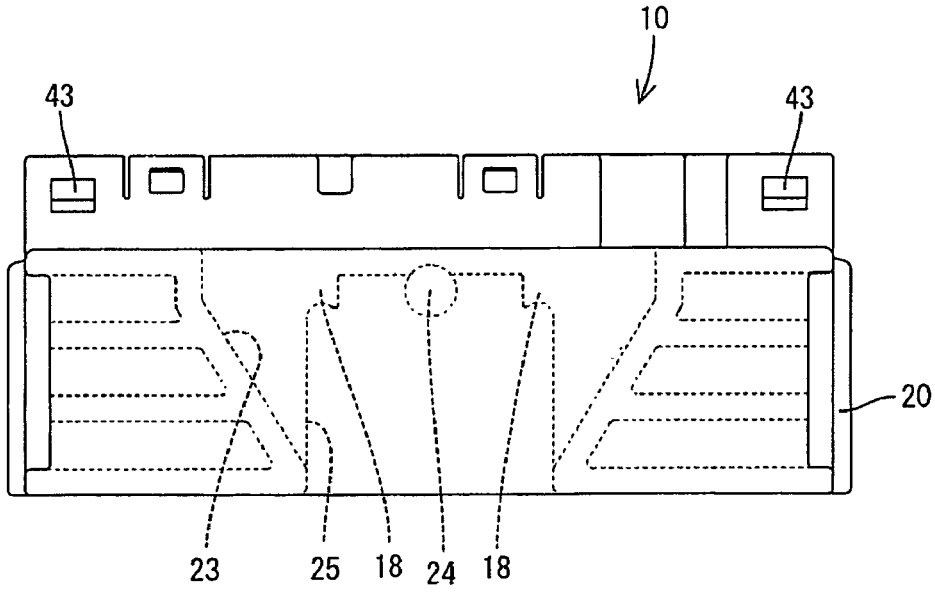
FIG. 5 is a front view of the female housing.
Figure 6:
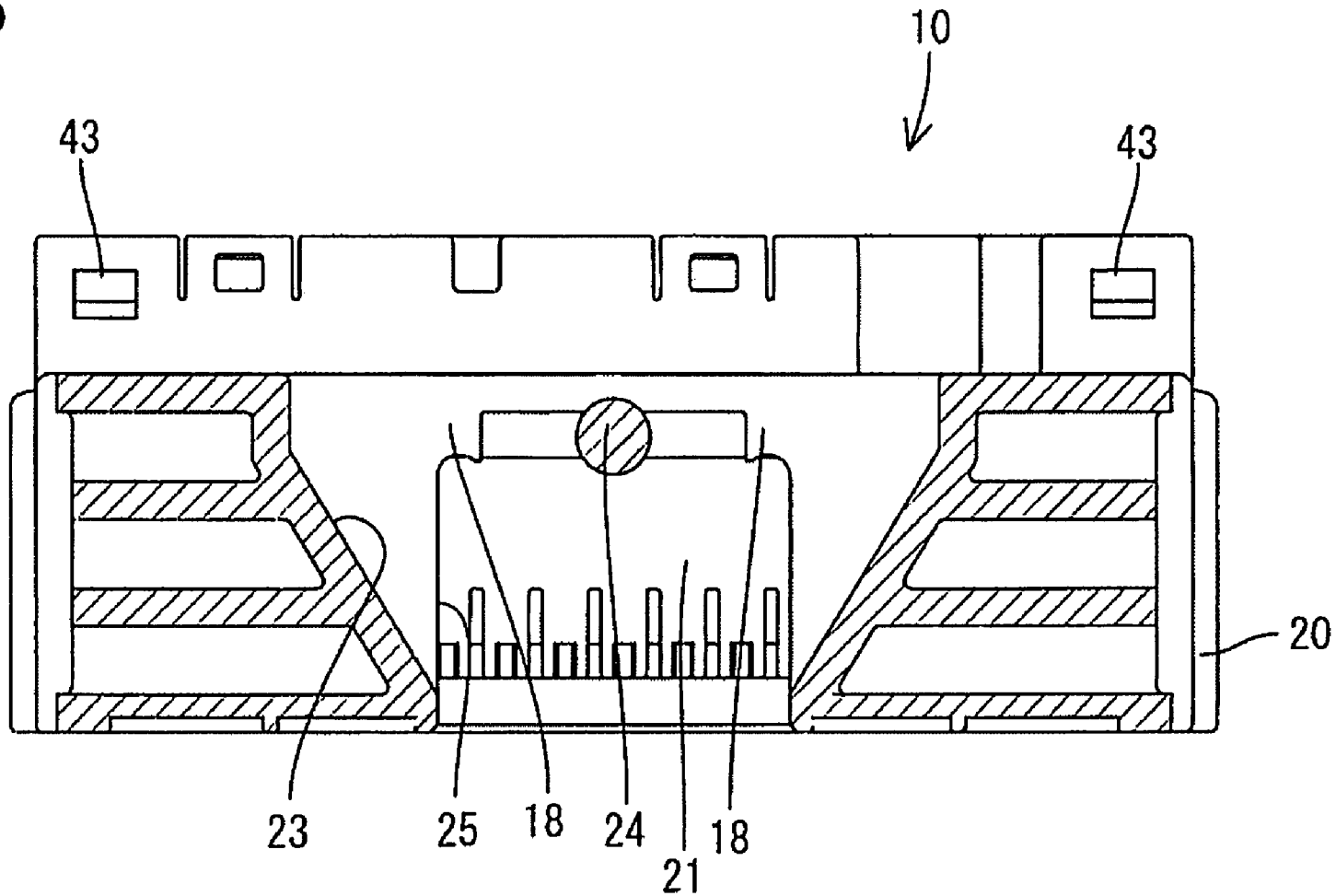
FIG. 6 is a section along 6—6 of FIG. 4.

A lever-type connector according to the invention is described with reference to FIGS. 1 to 13. The lever-type connector has a female housing 10, a lever 11 rotatably mounted to the female housing 10, and a male housing 12 connectable with the female housing 10 through the rotation of the lever 11. In the following description, connecting directions CD of the two housings 10, 12 are referred to as the forward directions.

The male housing 12 is made e.g. of a synthetic resin and has a receptacle 13 with an open front end. Long narrow bar-shaped male terminal fittings 14 penetrate through a back wall of the male housing 12 and project forward into the receptacle 13. Substantially cylindrical cam pins 15 project up and down at widthwise intermediate positions of the top and bottom surfaces of the receptacle 13. Restriction lifting projections 16 project from the top and bottom surfaces of the receptacle 13 at the opposite left and right sides of each cam pin 15 and extend substantially in forward and backward directions FBD and along the connecting direction CD. The restriction lifting projections 16 engage and resiliently deform a locking claw 17 in an unlocking direction UD during connection of the two housings 10, 12 for disengaging the locking claw 17 from an engaging portion 18 as described in detail later. Slanted surfaces 19 are formed at the front ends of the restriction lifting portions 16 to facilitate an upward deflection of the locking claw 17.

The female housing 10 is made e.g. of a synthetic resin and has an outer tube 20. An inner tube 21 is formed inside the outer tube 20 and a receptacle fitting space 22 is defined between the outer and inner tubes 20 and 21 for receiving the receptacle 13 of the male housing 12 during connection of the housings 10, 12. Lever accommodating spaces 23 are formed at upper and lower sides of the outer tube 20 and penetrate the outer tube 20 in forward and backward directions FBD. The lever 11 is accommodated in the spaces 23. A substantially cylindrical supporting shaft 24 extends down and in from the upper surface of the upper lever accommodating space 23, whereas a substantially cylindrical supporting shaft 24 extends up and in from the bottom surface of the lower lever accommodating space 23. Substantially rectangular cut-outs 25 extend back from the front edge at widthwise intermediate positions of each of the bottom wall of the upper lever accommodating space 23 and the upper wall of the lower lever accommodating space 23. The cam pins 15 of the male housing 12 and the restriction lifting portions 16 at the opposite sides of the cam pins 15 are insertable into the cut-outs 25. Each cut-out 25 is slightly wider than a spacing between the restriction lifting portions 16 at its front side, is narrowed with steps to have substantially the same width as the spacing between the restriction lifting portions 16 at an intermediate position with respect to a depth direction, and has a closed back end. Rounded or slanted engaging steps 18 are formed on the front of the upper and bottom wall of the lever accommodating space 23 at the cut-out 25. The respective engaging portions 18 are resiliently deformable along the thickness direction TD of the upper and bottom wall of the lever accommodating space 23.

Cavities 29 penetrate the inner tube 21 in forward and backward directions FBD for accommodating female terminal fittings 28 connected respectively with ends of wires 27. Each female terminal fitting 28 has a barrel 30 to be crimped, bent or folded into connection with the wire 27, and a substantially rectangular tube 31 adjacent the barrel 30. The male terminal fitting 14 is to be inserted into the rectangular tube portion 31 to establish an electrical connection between the male and female terminal fittings 14 and 28. A lock 32 is cantilevered substantially forward from an inner wall of each cavity 29 and is engageable with the rectangular tube 31 to retain the female terminal fitting 28. An accommodating recess 33 is formed at the rear end of the inner tube 21 and communicates with the rear ends of the cavities 29. A one-piece rubber plug 34 is accommodated in this accommodating recess 33. The plug 34 is a thick plate and plug-side insertion holes 35 penetrate the plug 34 in forward and backward directions FBD to permit passage of the wires 27. The inner surfaces of the plug-side insertion holes 35 closely contact the insulation coatings of the wires 27 to provide sealing between the plug 34 and the wires 27. The outer peripheral surface of the plug 34 closely contacts the inner peripheral surface of the accommodating recess 33 to provide sealing between the plug 34 and the female housing 10. A plug holder 36 is arranged behind the plug 34. Locking projections 37 project out from the outer surface of the plug holder 36 and engage receiving portions 38 formed near the rear end of the inner tube 21 to hold the plug holder 36 in the inner tube 21. Holder-side insertion holes 39 penetrate the plug holder 36 in forward and backward directions FBD to permit passage of the wires 27.

A wire cover 40 is to be mounted on the rear side of the female housing 10. The wire cover 40 is made e.g. of a synthetic resin and has a substantially box shape with opposed side plates and an opening that extends over the front and the left end in FIG. 1. A closed escaping surface 41 is substantially opposite the opening. Resilient locking legs 42 project from opposed positions on the front edges of the side plates of the wire cover 40 substantially adjacent the open end 44. Upper and lower protrusions 43 are formed at each of the left and right ends of the top and bottom surfaces near the rear end of the female housing 10.

The wire cover 40 is attached to the rear of the female housing 10 by engaging the resilient locking legs 42 with the protrusions 43 at either the left or right side so that the open end surface 44 faces laterally, e.g. leftward (see FIG. 1). Thus, the wires 27 drawn out from the rear surface of the female housing 10 are bundled and bent sideways at an angle of substantially at 90° for passage through the open end surface 44.

Figure 11:
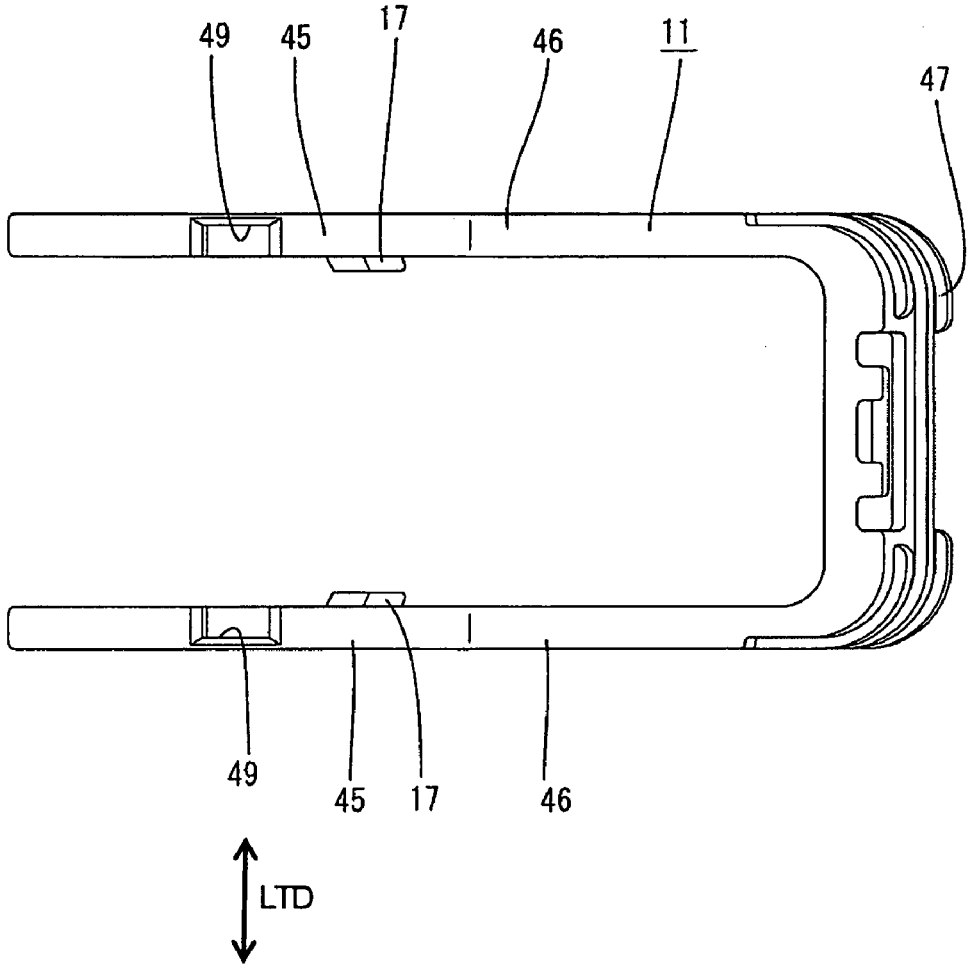
FIG. 11 is a bottom view of the lever.

The lever 11 is made e.g. of a synthetic resin and has two opposed round side plates 45, two opposed arms 46 that extend laterally from the outer peripheries of the round side plates 45 and an operable portion 47 that connects the arms 47 (see FIG. 11). The lever 11 is formed by a mold (not shown) that can open and close along the thickness direction of the side plates 45. Forward, backward, left and right directions in the description of the lever 11 are based on a state where the lever 11 is assembled to the female housing 10 at the standby position SP and ready for rotation in the operable direction OD to the connection position CP. Shaft holes 48 penetrate centers of the side plates 45, and the supporting shafts 24 are inserted into the shaft holes 46. Surfaces of the side plates 45 of the lever 11 that face each other are recessed in the thickness direction LTD of the side plates 45 to form cam grooves 49 that are engageable with the cam pins 15. Each cam groove 49 has a specified curved shape about the shaft hole 48, and the entrance of each cam groove 49 is at the peripheral edge of the side plate 45.

The lever 11 is inserted into the lever accommodating spaces 23 of the female housing 10 from behind so that the side plates 45 hold the female housing 10 therebetween. The supporting shafts 24 fit into the shaft holes 48 so that the lever 11 is rotatable about the supporting shafts 24 between the standby position SP and the connection position CP. The standby position SP is a position of the lever 11 where the entrances of the cam grooves 49 face the cam pins 15 so that the cam pins 15 can enter the cam grooves 49 (see FIG. 1). The connection position CP is a position of the lever 11 where the housings 10, 12 are connected completely (see FIG. 13).

Figure 13:
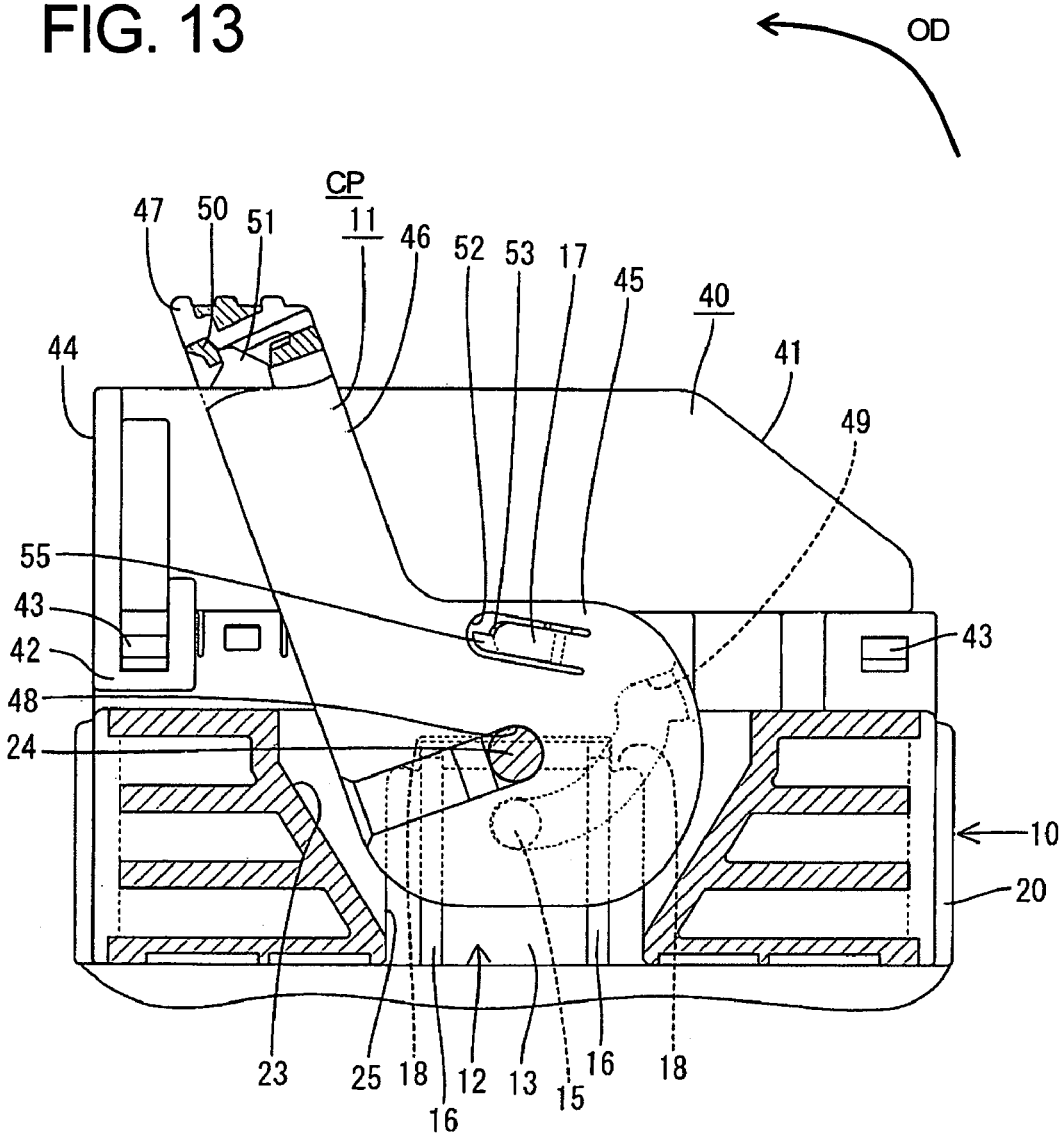
FIG. 13 is a plan view partly in section showing a connected state of the two housings.

The operable portion 47 contacts the rear surface of the wire cover 40 when the lever 11 is rotated counterclockwise in the operating direction OD from the standby position SP shown in FIG. 1 to the connection position CP shown in FIG. 13 to prevent further counterclockwise rotation. On the other hand, the operable portion 47 has a resiliently deformable locking piece 50, and a locking projection 51 is formed on the rear surface of the wire cover 40 at a position corresponding to the locking piece 50. Thus, the locking piece 50 engages the locking projection 51 to lock the lever 11 at the connection position CP and to prevent movement opposite the operating direction OD towards the standby position SP (i.e. a clockwise rotation in FIG. 13).

Figure 7:
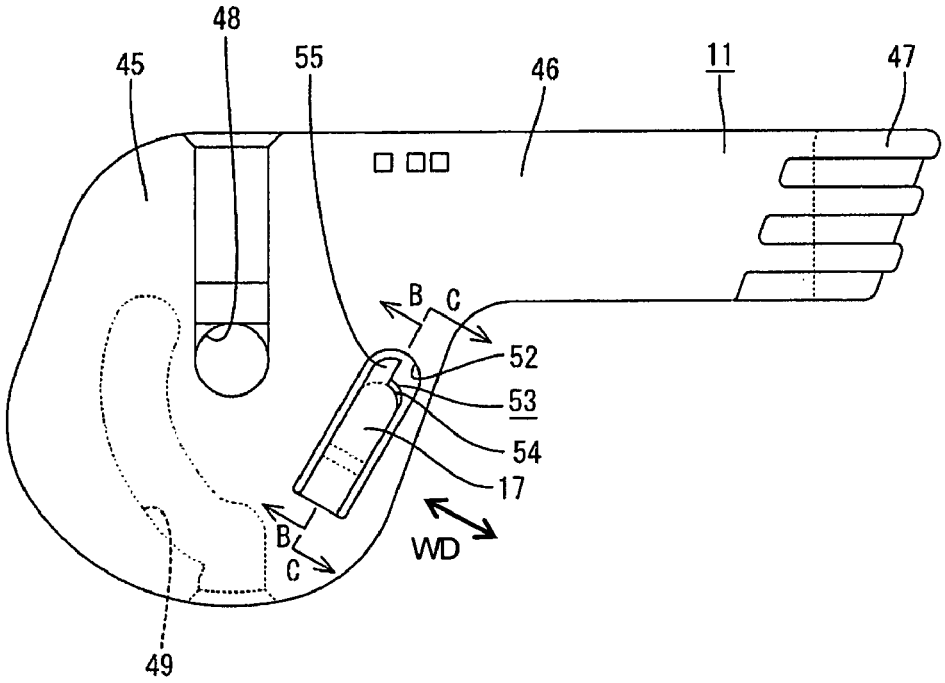
FIG. 7 is a plan view of the lever.
Figure 8:
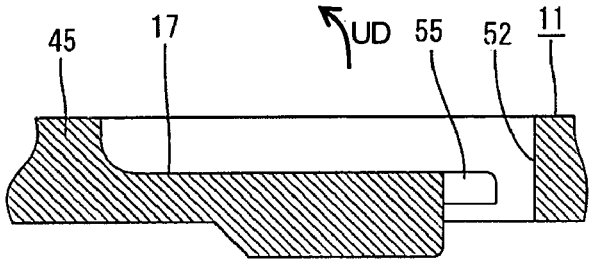
FIG. 8 is a section along 8—8 of FIG. 7.
Figure 9:
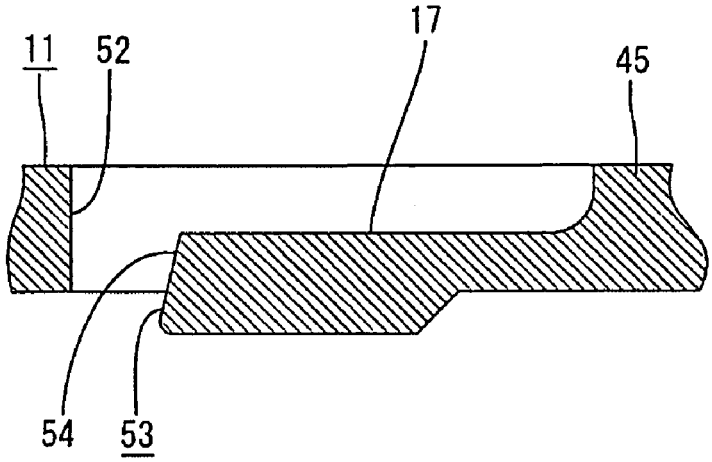
FIG. 9 is a section along 9—9 of FIG. 7.
Figure 10:
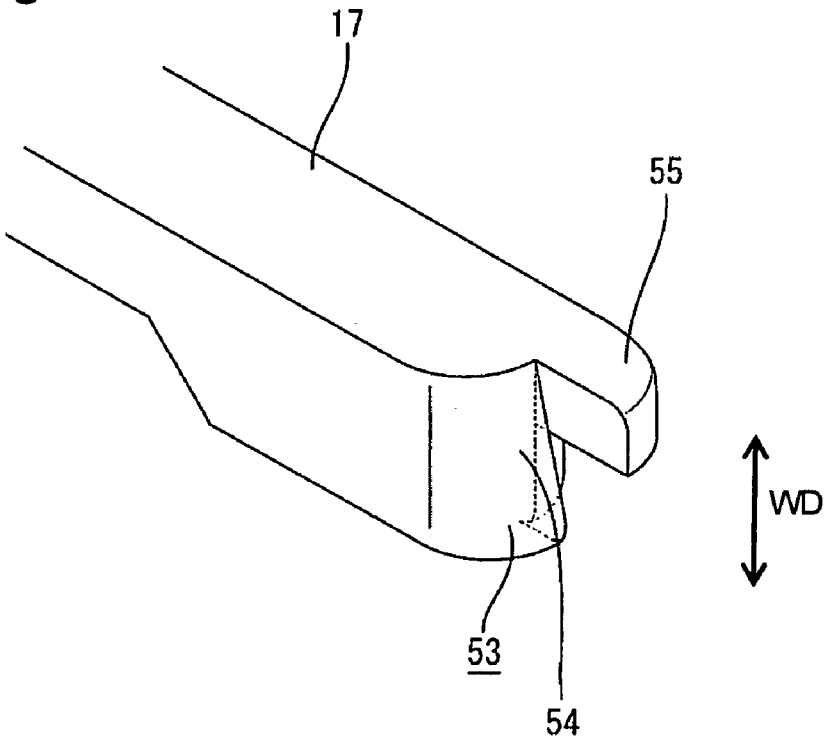
FIG. 10 is a partial enlarged perspective view of a locking claw 17.

As shown in FIG. 7, each side plate 45 has a locking claw 17 for engaging the engaging portion 18 of the female housing 10 at a side of the shaft hole 48 substantially opposite the end of the cam groove 49. The locking claw 17 is formed inside a substantially U-shaped slit 52 in the side plate 45, and has a long narrow shape aligned substantially in forward and backward directions. The free end of the locking claw 17 is resiliently deformable in an unlocking direction UD which extends along the thickness direction LTD of the side plate 45. The inner surface of the locking claw 17 projects from the inner surface of the side plate 45 (see FIG. 11).

A contact surface 53 is formed at the right-lower side of the leading end of the locking claw 17 in FIG. 7 for contacting the engaging portion 18. The contact surface 53 has a slanted surface 54 that can exert a force acting down in FIG. 12(A) and opposite to an unlocking direction UD (up in FIG. 12(A)) of the locking claw 17 when the contact surface 53 contacts the engaging portion 18. Specifically, the slanted surface 54 is rounded obliquely down to the right in FIG. 12(A) to prevent deformation of the locking claw 17 in the unlocking direction UD when the locking claw 17 and the engaging portion 18 contact. Thus, the locking claw 17 and the engaging portion 18 engage securely.

A turn-up preventing portion 55 is formed at a left-upper side of the leading end of the locking claw 17 in FIG. 7 and projects away from the opening of the cam groove 49 (back in FIG. 7). The turn-up preventing portion 55 presses the engaging portion 18 in a direction opposite the unlocking direction UD of the locking claw 17 and prevents the engaging portion 18 from being turned up and moving onto the slanted surface 54 when the contact surface 53 contacts the engaging portion 18. Thus, sufficient holding force is ensured between the locking claw 17 and the engaging portion 18 (see FIG. 12(*a*)).

As described above, the slanted surface 54 and the turn-up preventing portion 55 are displaced from each other in the width direction WD of the locking claw 17. Thus, the lever 11 can be formed using a mold that opens and closes along the thickness direction of the locking claw 17.

A rotation path of the lever 11 from the standby position SP to the connection position CP is in substantially the same direction as the path in which the contact surfaces 53 contact the engaging portions 18. Thus, contact of the locking claws 17 and the engaging portions 18 of the female housing 10 (see FIG. 12(*a*)) prevents rotation of the lever 11 in the operating direction OD from the standby position SP towards the connection position CP.

The female and male housings 10, 12 can be fit lightly together with the lever 11 held at the standby position SP. As a result, the restricting lifting portions 16 on the male housing 12 contact the locking claws 17 from the inner side and deform the locking claws 17 out on the female housing 10 and in the unlocking direction UD (see FIG. 12(*b*)). The locking claws 17 are freed from the locked state and slide on the inner surfaces of the bottom wall of the upper lever accommodating space 23 and the upper wall of the lower lever accommodating space 23 as the lever 11 is rotated. Thus, the lever 11 is displaced in the operating direction OD towards the connection position CP.

The connector is assembled by mounting the wire cover 40 on the rear surface of the female housing 10 with the open end 44 of the cover 40 facing in a lateral direction appropriate for proper orientation and direction of the wires 27. The lever 11 then is mounted on the supporting shafts 24 in the lever accommodating spaces 23 of the housing 10 so that lever 11 is at the standby position SP and so that the operable portion 47 is at the side of the escaping surface 41 of the wire cover 40. Accordingly, the entrances of the cam grooves 49 face forward and towards the male housing 12 in intermediate positions of the cut-outs 25.

An attempt could be made to rotate the lever 11 in the operating direction OD towards the connection position CP with the lever 11 at the standby position SP. However, the contact surfaces 53 at the leading ends of the locking claws 17 contact the engaging portions 18. The engaging portions 18 exert forces on the slanted surfaces 54 on the contact surfaces 53 in directions opposite to the unlocking directions UD of the locking claws 17. As a result, the locking claws 17 and the engaging portions 18 engage securely to ensure a sufficient holding force for holding the lever 11 at the standby position SP. The engaging portions 18 at the resiliently deformable free ends could be deformed to be turn up and move onto the slanted surfaces 54 (see FIG. 12(*a*)). However, the turn-up preventing portions 55 press the engaging portions 18 from the opposite sides of the locking claws 17 and prevent the engaging portions 18 from being turned up in unlocking direction UD. Therefore, the holding forces of the locking claws 17 and the engaging portions 18 are increased further. In this way, the lever 11 is held so as not to inadvertently rotate toward the connection position CP.

Figure 12A:
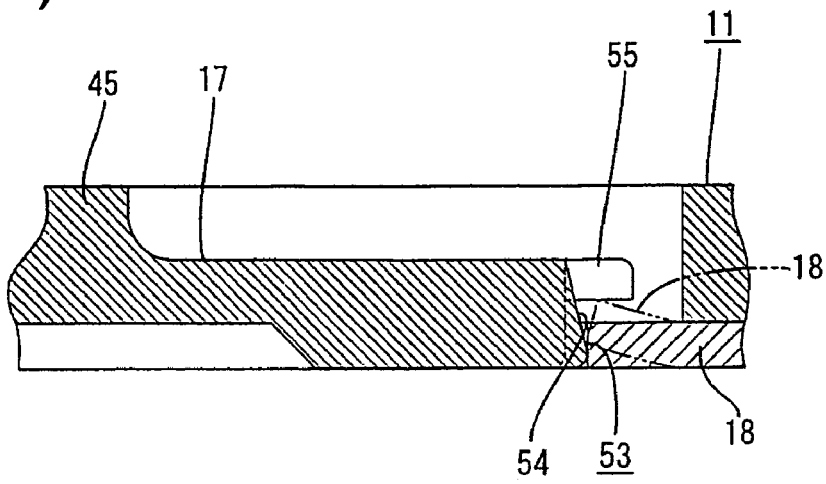
FIG. 12(*a*) is a partial enlarged section showing an engaged state of the locking claw and an engaging portion and FIG. 12(*b*) is a partial enlarged section showing an operation of disengaging the locking claw from the engaging portion.
Figure 12B:
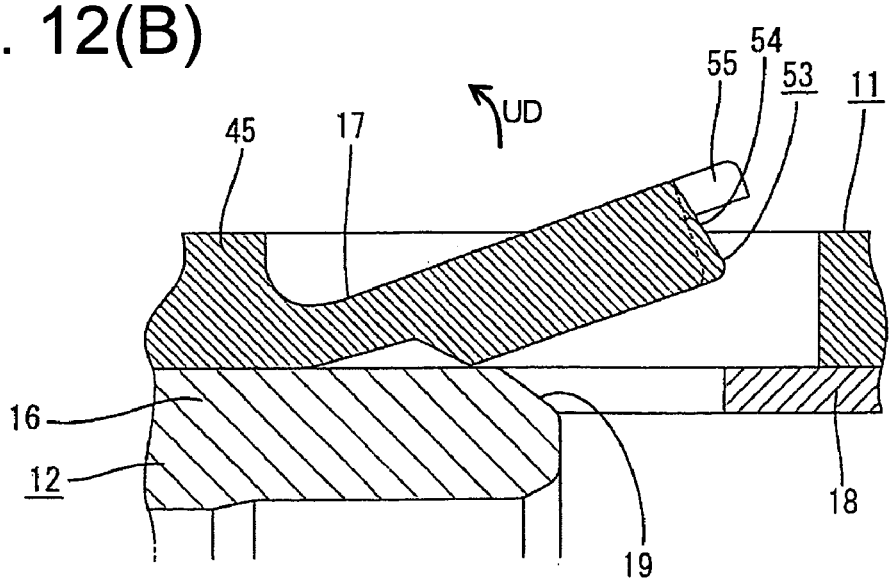

The female housing 10 can be fit lightly to the mating male housing 12 along the connecting direction CD, as shown by an arrow in FIG. 1. Thus, the cam pins 15 of the male housing 12 enter the cam grooves 49 and the restriction lifting portions 16 enter the cut-outs 25. Accordingly, the restriction lifting portions 16 deform the locking claws 17 out in the unlocking direction UD and the slanted surfaces 19 slip under the locking claws 17 and disengage the locking claws 17 from the engaging portions 18 as shown in FIG. 12(*b*). In this way, the restriction on the rotation of the lever 11 to the connection position CP is canceled. The operating direction OD of the lever 11 at the standby position SP (up in FIG. 1) is substantially opposite the connecting direction CD (down in FIG. 1) of the housings 10, 12. Thus, the lever 11 is operated towards the connection position CP in a direction opposite to the direction necessary for connecting the two housings 10, 20. The locking claws 17 and the engaging portions 18 are not engaged upon connecting the two housings 10, 12, and the restriction can be canceled easily.

The lever 11 is rotated in the operating direction OD (counterclockwise in FIG. 13) by manipulating the operable portion 47. Thus, the female housing 10 is pulled towards the male housing 12 by a cam action of the cam pins 15 moving along the cam grooves 49 towards the back ends of the cam grooves 49. The cam pins 15 reach the back ends of the cam grooves 49 when the lever 11 is rotated to the connection position CP, as shown in FIG. 13, and the two housings 10, 20 are connected completely. At this time, the locking piece 50 in the operable portion 47 engages the locking projection 37 of the wire cover 40 to prevent a returning movement of the lever 11 and to lock the housings 10, 20 in their completely connected state.

The housings 10, 12 may have to be separated, for example, for maintenance. Thus, the locking piece 50 is deformed forcibly and disengaged from the locking projection 37. Thereafter, the lever 11 is rotated opposite to the above-described operating direction OD toward the standby position SP. As a result, the cam pins 15 move in an opposite direction in the cam grooves 49 and display a cam action to separate the two housings 10, 20.

As described above, the contact surfaces 53 have the slanted surfaces 54 that exert forces on the locking claws 17 opposite to the unlocking directions UD of the locking claws 17 when the engaging portions 18 contact the contact surfaces 53. Thus, the locking claws 17 will not deform in the unlocking directions UD when the engaging portions 18 contact the contact surfaces 53. Accordingly, the locking claws 17 and the engaging portions 18 are engaged securely.

Further, the turn-up preventing portions 55 on the locking claws 17 prevent the engaging portions 18 from turning up in the unlocking direction UD and onto the locking claws 17 in response to contact with the contact surfaces 53. Thus, sufficient holding forces are ensured between the locking claws 17 and the engaging portions 18.

The locking claws 17 are formed inside the slits 52 made in the side plates 45 and are arranged inside the rotation path of the lever 11 to prevent the enlargement of the rotation path of the lever 11 and enlargement of the female housing 10.

The turn-up preventing portions 55 and the slanted surfaces 54 are displaced in the width direction WD. Thus, the turn-up preventing portions 55 and the slanted surfaces 54 can be formed even if the mold opens and closes along the thickness direction of the locking claws 17.

The locking claws 17 and the engaging portions 18 can be disengaged by the restriction lifting portions 16 by lightly fitting the female and male housings 10, 12. Thus, operation efficiency is improved as compared to a case where a separate process of disengaging the locking claws 17 and the engaging portions 18 is necessary.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The lever 11 is substantially gate-shaped and rotatably mounted in the female housing 10 in the foregoing embodiment. However, the lever 11 may be a plate-shaped rotary lever or a slide lever. Particularly, the operable member may be a slider movable along a linear, bent or elliptic path.

The contact surfaces 53 are formed with the slanted surfaces 54 for exerting forces acting in directions opposite to the unlocking direction UD of the locking claws 17 in the foregoing embodiment. However, the contact surfaces 53 may be formed at an angle to a direction in which the contact surfaces 53 contact the engaging portions 18. In such a case, the contact surfaces 53 also can be formed by the mold that opens and closes along the thickness direction of the locking claws 17. Therefore, the contact surfaces 53 and the turn-up preventing portions 55 can be arranged to overlap in the thickness direction of the locking claws 17.

The wires 27 are drawn out to the left in FIG. 1. However, the wires 27 may be drawn out to the right. In such a case, the wire cover 40 is mounted so that the open end 44 faces to the right and the lever 11 is supported on the supporting shafts 24 at the standby position where the operable portion 47 faces left. At this time, the left engaging portions 18 are used to lock the lever 11 at the standby position. The succeeding process is not described because it differs form the foregoing embodiment only in the rotating direction of the lever 11 are reversed. Moreover, the cover may be dispensed with completely.

The locking claws 17 are formed inside the slits 52 in the side plates 45 of the lever 11 in the foregoing embodiment. However, the locking claws 17 may project outward from the lateral edges of the side plates 45. Alternatively, only areas of the locking claws 17 different from those where the slanted surfaces 54 and the turn-up preventing portions 55 are formed may be surrounded by the slits 52. The mold can be removed in a direction intersecting the thickness direction of the locking claws 17 in such a case. Thus, the slanted surfaces 54 and the turn-up preventing portions 55 can overlap in the thickness direction of the locking claws 17.

The lever 11 is in the lever accommodating spaces 23 in the female housing 10 in the foregoing embodiment. However, the lever 11 may be exposed on the outer walls of the female housing 10.

Although the first housing is the female housing 10 and the second housing is the male housing 12 in the foregoing embodiment, the present invention is not limited thereto and the first housing may be the male housing 12 and the second housing may be the female housing 10.

What is claimed is:

1. A connector, comprising:

a housing (10) connectable with a mating housing (12) of a mating connector, the housing (10) having an engaging portion (18);

a movable member (11) having at least one side plate (45) mounted to the housing (10) for displacement between a standby position (SP) and a connection position (CP), at least one cam (49) formed in the side plate (45) and being engageable with a mating cam (15) of the mating housing (12) for displaying a cam action to connect the housing (10) with the mating housing (12) when the operable member (11) is displaced towards the connection position (CP); and at least one resiliently deformable locking claw (17) formed in the side plate (45), the locking claw (17) having a contact surface (53) for engaging the engaging portion (18) of the housing (10) when the movable member (11) is at the standby position (SP) for preventing the movable member (11) from being displaced towards the connection position (CP), the locking claw (17) further having a deformation preventing portion (55) for pressing the engaging portion (18) and preventing the engaging portion (18) from being deformed when the contact surface (53) and the engaging portion (18) contact each other for further preventing displacement of towards the connection position (CP).

2. The connector of claim 1, wherein the locking claw (17) is resiliently deformable in an unlocking direction for separation from the engaging portion (18) of the housing (10) so that the movable member (18) can be moved on the housing (10).

3. The connector of claim 2, wherein the contact surface (53) includes a slanted surface (54) for exerting a force in a direction opposite to the unlocking direction (UD) of the locking claw (17) when the contact surface (53) contacts the engaging portion (18).

4. The connector of claim 1, wherein the movable member (11) is made of a synthetic resin, the locking claw (17) being formed inside a slit (52) in the side plate (45) and formed by a mold openable and closable along a thickness direction of the side plate (45).

5. The connector of claim 4, wherein the slanted surface (54) is displaced from the deformation preventing portion (55) in a width direction (WD) of the locking claw (17).

6. A connector assembly comprising:

a housing (10) formed with an engaging portion (18);

a movable member (11) having at least one side plate (45) mounted to the housing (10) for displacement along an operating direction (OD) between a standby position (SP) and a connection position (CP), at least one cam (49) formed in the side plate (45), at least one resiliently deformable locking claw (17) formed in the side plate (45), the locking claw (17) having a contact surface (53) for engaging the engaging portion (18) of the housing (10) when the movable member (11) is at the standby position (SP) for preventing the movable member (11) from being displaced from the standby position (SP), the locking claw (17) further having a deformation preventing portion (55) for pressing the engaging portion (18) and preventing the engaging portion (18) from being deformed when the contact surface (53) and the engaging portion (18) contact each other for further preventing displacement of the movable member (11) from the standby position (SP); and a mating housing (12) configured for connection with the housing (10) along a connecting direction (CD), the mating housing (12) having a surface (19) disposed and configured for engaging the locking claw (17) and deflecting the locking claw (17) in an unlocking direction (UD) and out of engagement with the engaging portion (18) of the housing (18) so that the movable member (11) can be moved to the connection position (CP), the mating housing (12) being formed with at least one mating cam (15) for engaging the cam (49) and displaying a cam action for connecting the housings (10, 12) as the movable member (11) is moved to the connection position (CP).

7. The connector assembly of claim 6, wherein the operating direction (OD) of the movable member (11) from the standby position (SP) to the connection position (CP) is substantially opposite the connecting direction (CD) of the housings (10, 12).

8. The connector assembly of claim 7, wherein a displacement path of the movable member (11) from the standby position (SP) to the connection position (CP) is substantially in a direction in which the contact surface (53) contacts the engaging portion (18).

9. The connector assembly of claim 6, wherein the movable member (11) is a lever (11) mounted rotatably to the housing (10).

* * * * *